US011066839B2

(12) United States Patent
Weise et al.

(10) Patent No.: US 11,066,839 B2
(45) Date of Patent: Jul. 20, 2021

(54) MODULAR SYSTEM AND METHOD FOR CONCRETE CRACK REPAIR

(71) Applicant: AquaBond LLC, Long Beach, CA (US)

(72) Inventors: Gary Weise, San Juan Capistrano, CA (US); David Poer, Rancho Mission Viejo, CA (US)

(73) Assignee: AquaBond LLC, Long Beach, CA (US)

( * ) Notice: Subject to any disclaimer, the term of this patent is extended or adjusted under 35 U.S.C. 154(b) by 0 days.

(21) Appl. No.: 16/731,919

(22) Filed: Dec. 31, 2019

(65) Prior Publication Data

US 2020/0208421 A1 Jul. 2, 2020

Related U.S. Application Data

(60) Provisional application No. 62/787,052, filed on Dec. 31, 2018.

(51) Int. Cl.
*E04G 23/02* (2006.01)
*E04C 5/16* (2006.01)

(52) U.S. Cl.
CPC ..... *E04G 23/0203* (2013.01); *E04C 5/162* (2013.01); *E04G 23/0218* (2013.01)

(58) Field of Classification Search
CPC ..... E04G 23/0203; E04G 23/0218; E04G 23/0211; E04C 5/162; E04C 5/015; E04C 5/07; E04C 5/012
See application file for complete search history.

(56) References Cited

U.S. PATENT DOCUMENTS 3,953,953 A * 5/1976 Marsden ..... B21D 53/00 428/603
5,115,622 A * 5/1992 Ammann ..... E04G 23/0218 52/231
5,476,340 A 12/1995 Contrasto
5,771,557 A 6/1998 Contrasto
5,791,816 A * 8/1998 McCallion ..... E04C 5/20 404/136
6,401,406 B1 * 6/2002 Komara ..... E04B 1/4157 52/127.3
7,448,176 B2 * 11/2008 Drake ..... E01C 7/147 404/34
7,513,024 B2 4/2009 Keller
(Continued)

FOREIGN PATENT DOCUMENTS

JP 2010275709 A * 12/2010 ..... E04G 23/0218
KR 20160052474 A * 5/2016
(Continued)

*Primary Examiner* — Rodney Mintz
(74) *Attorney, Agent, or Firm* — Michael Best and Friedrich LLP

(57) ABSTRACT

A system for repairing a crack in a concrete installation includes a stitch having a center portion configured to span across the crack and an anchor plate coupled to the stitch. The anchor plate includes an anchor bore configured to receive a concrete anchor, a first bore extending parallel to the anchor bore, a second bore extending transverse to the anchor bore, and a groove extending transverse to the first bore and the second bore. The first bore intersects the groove, and the second bore intersects the anchor bore.

17 Claims, 12 Drawing Sheets

(56) References Cited

U.S. PATENT DOCUMENTS

| | | | | |
|---|---|---|---|---|
| 8,806,836 | B2 * | 8/2014 | James | E04G 23/0218 52/698 |
| 9,523,207 | B2 | 12/2016 | Weber | |
| 9,963,870 | B2 | 5/2018 | Merlob | |
| 10,190,314 | B2 * | 1/2019 | Garot | B23K 1/0008 |
| 10,208,447 | B1 * | 2/2019 | May | E04G 23/0203 |
| 10,208,492 | B2 * | 2/2019 | Mayer | E04G 21/3276 |
| D857,487 | S * | 8/2019 | Thompson | D8/390 |
| 10,801,221 | B2 * | 10/2020 | Secrest | E04G 23/0288 |
| 10,907,899 | B1 * | 2/2021 | Lanclos | E04B 1/40 |
| 2003/0154683 | A1 * | 8/2003 | Bache | E04C 5/012 52/586.1 |
| 2004/0200173 | A1 * | 10/2004 | Drake | E01C 23/0933 52/514.5 |
| 2005/0120660 | A1 * | 6/2005 | Kim | E04G 23/0203 52/514 |
| 2012/0227351 | A1 * | 9/2012 | James | E04B 1/4157 52/705 |
| 2015/0068154 | A1 * | 3/2015 | Merlob | E04G 23/0203 52/741.1 |
| 2015/0300033 | A1 * | 10/2015 | Weber | E04C 5/162 52/514 |
| 2016/0047124 | A1 * | 2/2016 | Garot | B23K 1/0008 403/265 |
| 2017/0130473 | A1 | 5/2017 | Weise | |
| 2018/0058062 | A1 * | 3/2018 | Mayer | E04B 1/4142 |
| 2019/0085574 | A1 * | 3/2019 | Weise | E04C 5/165 |

FOREIGN PATENT DOCUMENTS

| | | | |
|---|---|---|---|
| KR | 20170111836 | A * | 10/2017 |
| KR | 20170112142 | A * | 10/2017 |

* cited by examiner

MODULAR SYSTEM AND METHOD FOR CONCRETE CRACK REPAIR

CROSS-REFERENCE TO RELATED APPLICATIONS

This application claims priority to co-pending U.S. Provisional Patent Application No. 62/787,052, filed on Dec. 31, 2018, the entire content of which is incorporated herein by reference.

FIELD OF THE INVENTION

The present invention relates to concrete fabrication and repair, and more particularly to a modular system and method for concrete crack repair.

BACKGROUND OF THE INVENTION

Although mechanically strong in compression, concrete is relatively weak in tensile and bending loads and may be subject to cracking and breakage under such conditions. Concrete installations typically include strengthening material, such as rebar, to increase tensile strength. Some concrete installations use a post-tensioning technique to preload the concrete and place it under a resting compressive load. This counteracts tensile and bending loads to mitigate mechanical failures. Over time, however, environmental factors such as frost heaving, ground movement, erosion, water infiltration, and the like may still cause cracking and mechanical failure of installed concrete.

Reinforcement and post-tensioning are typically performed during original installation of concrete. Reinforcement and optionally, post-tensioning, can also be advantageously applied to concrete repairs. Typically, a metal rod is recessed into the concrete such that the rod spans across the crack to be repaired. Where post-tensioning is desired, tension may be applied across the rod to close the crack. New concrete may be applied over the rod to complete the repair. Current repair systems, however, are limited to use in repairing easily accessible cracks with relatively simple geometries (e.g., on sidewalks, driveways, roads, etc.).

SUMMARY OF THE INVENTION

The present invention provides, in one aspect, a system for repairing a crack in a concrete installation. The system includes a stitch having a center portion configured to span across the crack and an anchor plate coupled to the stitch. The anchor plate includes an anchor bore configured to receive a concrete anchor, a first bore extending parallel to the anchor bore, a second bore extending transverse to the anchor bore, and a groove extending transverse to the first bore and the second bore. The first bore intersects the groove, and the second bore intersects the anchor bore.

The present invention provides, in another aspect, an anchor plate for coupling to a stitch that extends across a crack in a concrete installation. The anchor plate includes a top side, a bottom side opposite the top side, a first lateral side extending between the top side and the bottom side, a second lateral side extending between the top side and the bottom side, a third lateral side extending between the top side and the bottom side opposite the first lateral side, a fourth lateral side extending between the top side and the bottom side opposite the second lateral side, an anchor bore configured to receive a concrete anchor, the anchor bore extending through the top side and the bottom side, a first bore extending through the top side and the bottom side, a second bore extending through the second lateral side, and a groove formed in the bottom side, the groove extending between the first lateral side and the third lateral side.

The present invention provides, in another aspect, a method of repairing a crack in a concrete installation. The method includes forming a first recess in the concrete installation on a first side of the crack, forming a second recess in the concrete installation on a second side of the crack opposite the first side, forming a channel in the concrete installation between the first and second recesses, applying an epoxy into the first recess, the second recess, and the channel, and positioning a stitch in the channel such that a center portion of the stitch spans across the crack from the first side to the second side. Positioning the stitch in the channel includes positioning a first end segment of the stitch in the first recess and positioning a second end segment of the stitch in the second recess. The first end segment and the second end segment are angled relative to the center portion.

Other features and aspects of the invention will become apparent by consideration of the following detailed description and accompanying drawings.

Before any embodiments of the invention are explained in detail, it is to be understood that the invention is not limited in its application to the details of construction and the arrangement of components set forth in the following description or illustrated in the following drawings. The invention is capable of other embodiments and of being practiced or of being carried out in various ways. Also, it is to be understood that the phraseology and terminology used herein is for the purpose of description and should not be regarded as limiting.

DETAILED DESCRIPTION

Figure 1:
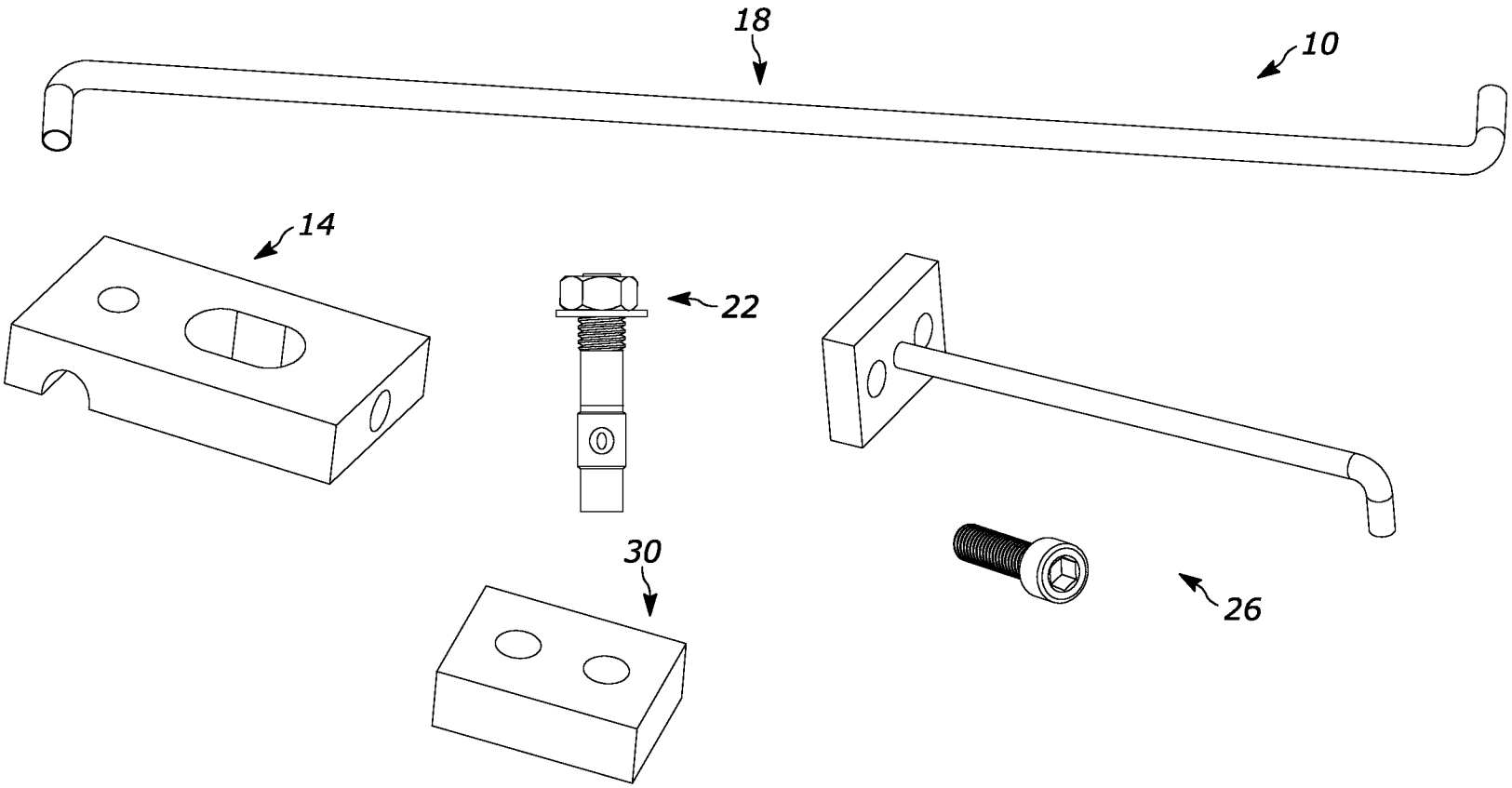
FIG. 1 illustrates a modular concrete crack repair system according to one embodiment of the present invention.

FIG. 1 illustrates a modular concrete crack repair system 10 according to one embodiment of the present invention. The illustrated system 10 includes an anchor plate 14, a stitch 18, an anchor 22 (e.g., a threaded, expanding sleeve-type masonry anchor), a tensioning assembly 26, and a bridge plate 30. As described herein, a stitch (such as the stitch 18) may also be referred to as a rod. The modularity of the system 10 relates to the ability to select and use different components and features of the system 10 based upon the location, substrate, crack geometry, desired tensioning properties, and other relevant variables in the repair of a concrete installation or structure. That is, any of the components of the system 10 may be provided in multiple quantities to provide a configuration to suit a particular application. Likewise, certain components of the system 10 may be omitted in some configurations to suit a particular application.

Figure 2B:
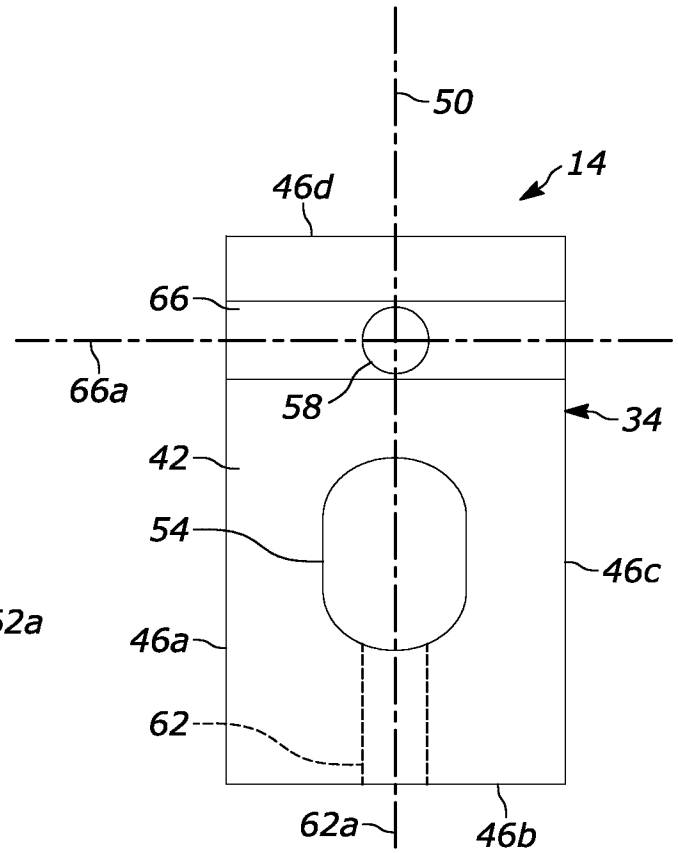
FIG. 2B is a bottom view of the anchor plate of FIG. 2A.
Figure 2A:
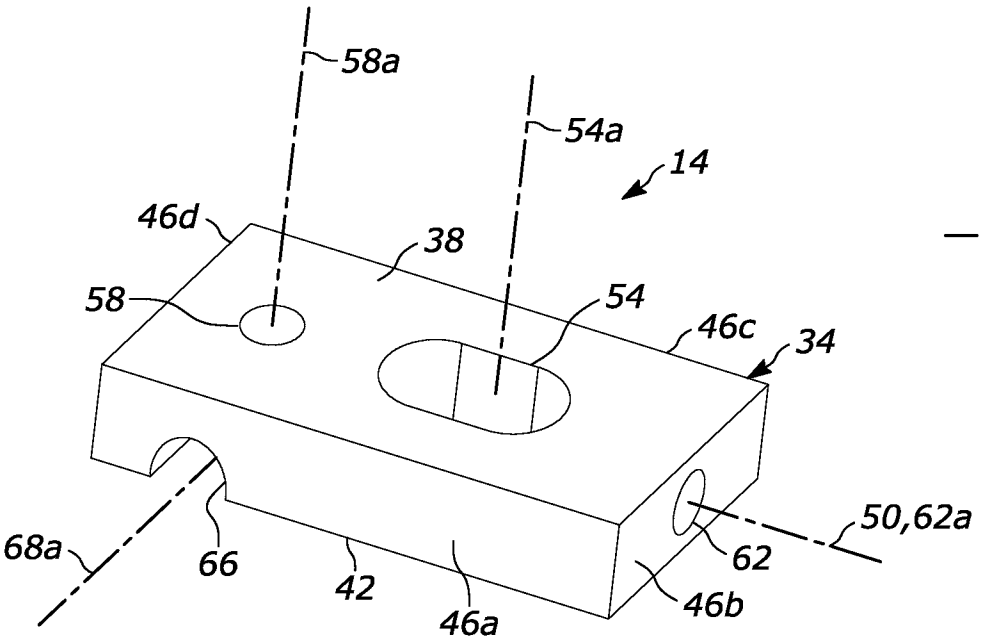
FIG. 2A is a perspective view of an anchor plate of the system of FIG. 1.

With reference to FIGS. 2A-B, the illustrated anchor plate 14 includes a main body 34 with a top side 38, a bottom side 42 opposite the top side 38, and four lateral sides 46*a*, 46*b*, 46*c*, 46*d* extending between the top side 38 and the bottom side 42. The spatial terms top, bottom, and lateral are used herein for convenience and with reference to the orientation of the anchor plate 14 illustrated in FIG. 2A. In use, however, the anchor plate 14 may be oriented in various ways. A longitudinal axis 50 of the main body 34 extends centrally through the second and fourth lateral sides 46*b*, 46*d*. The first and third lateral sides 46*a*, 46*c*, which extend parallel to the longitudinal axis 50, are longer than the second and fourth lateral sides 46*b*, 46*d*. As such, the illustrated anchor plate 14 is rectangular. In other embodiments, the anchor plate 14 may be square or may have other shapes.

An anchor bore 54 extends through the main body 34 of the anchor plate 14 from the top side 38 to the bottom side 42. In the illustrated embodiment, the anchor bore 54 extends perpendicular or transverse to the longitudinal axis 50 and is elongated in the direction of the longitudinal axis 50 (FIG. 2B). The anchor bore 54 is configured to receive the anchor 22 (FIG. 1), and the elongated shape of the anchor bore 54 advantageously allows for greater tolerance when placing the anchor 22. In other embodiments, however, the anchor bore 54 may be circular or have other shapes.

The anchor plate 14 further includes a plurality of attachment features to facilitate coupling the stitch 18, the tensioning assembly 26, or both to the anchor plate 14. In the illustrated embodiment, the plurality of attachment features includes a first bore 58 extending through the top side 38, a second bore 62 extending through the second lateral side 46*b*, and a groove 66 formed in the bottom side 42 of the main body 34. The first bore 58 extends through the main body 34 and intersects a center of the groove 66. The second bore 62 extends along the longitudinal axis 50 from the second lateral side 46*b* and intersects anchor bore 54. As such, in the illustrated embodiment, the first bore 58 communicates with the groove 66, and the second bore 62 communicates with the anchor bore 54.

With reference to FIG. 2A, the anchor bore 54 defines an anchor bore axis 54*a* extending centrally through the anchor bore 54, the first bore 58 defines a first bore axis 58*a* extending centrally through the first bore 58, the second bore 62 defines a second bore axis 62*a* extending centrally through the second bore 62, and the groove 66 defines a groove axis 66*a* extending centrally through the groove 66. In the illustrated embodiment, the second bore axis 62*a* is coaxial with the longitudinal axis 50.

The anchor bore axis 54*a* is perpendicular or transverse to the longitudinal axis 50 (and the second bore axis 62*a*), and the first bore axis 58*a* is parallel to the anchor bore axis 54*a*. The first bore axis 58*a*, the second bore axis 62*a*, the longitudinal axis 50, and the anchor bore axis 54*a* are coplanar. The groove 66 extends along the bottom side 42, from the first lateral side 46*a* to the third lateral side 46*c* and parallel to the second and fourth lateral sides 46*b*, 46*d* of the main body 34. As such, the groove axis 66*a* is perpendicular or transverse to each of the first bore axis 58*a*, the second bore axis 62*a*, the anchor bore axis 54*a*, and the longitudinal axis 50. In other embodiments, the relative position or orientation of one or more of the attachment features may differ.

In the illustrated embodiment, the groove 66 has a semi-circular cross-section. The groove 66, the first bore 58, and the second bore 62 each have approximately the same diameter. As described in greater detail below, the diameter of each of these attachment features is sized to receive at least a portion of the stitch 18, the tensioning assembly 26, or both.

Figure 3A:
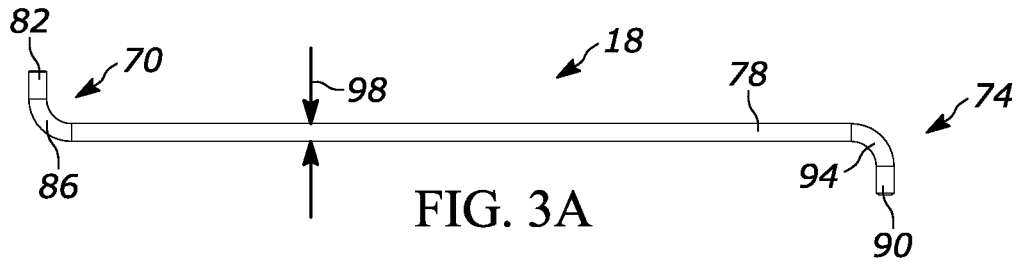
FIG. 3A is a plan view of a stitch of the system of FIG. 1.

An exemplary stitch 18 for use with the system 10 is illustrated in FIG. 3A. In the illustrated embodiment, the stitch 18 includes a first end portion 70, a second end portion 74 opposite the first end portion 70, and a center portion 78 spanning between the end portions 70, 74. The first end portion 70 includes a first end segment 82 and a first curved transition 86 between the first end segment 82 and the center portion 78, and the second end portion 74 includes a second end segment 90 and a second curved transition 94 between the second end segment 90 and the center portion 78. The first end segment 82 and the second end segment 90 in the illustrated embodiment each extend perpendicular or transverse to the center portion 78 of the stitch 18 and in opposite directions. As such, the end segments 82, 90 and the center portion 78 have centers that are coplanar, and the stitch 18 is S-shaped. In other embodiments, one or both end segments 82, 90 may be obliquely oriented relative to the center portion 78, and the end segments 82, 90 may not be coplanar.

With continued reference to FIG. 3A, the illustrated stitch 18 has a round cross-section with a generally constant diameter 98. That is, the diameter 98 of the center portion 78 is equal to the diameter of each end portion 70, 74. The diameter 98 is sized such that at least a portion of the stitch 18 is insertable into each of the attachment features of the anchor plate 14.

The stitch 18 is formed from a unitary piece of rigid, high-strength material, such as steel, fiber-reinforced composite, fiberglass, or any other material suitable for use in concrete repair. In certain embodiments, the stitch 18 comprises a cold-rolled material, including cold rolled alloys sometimes referred to by the trade name Stressproof®. The cold-rolled material can comprise a material conforming to AISI 1144. AISI 1144 steel is a carbon-manganese grade steel which is cold worked to produce high tensile properties. In some embodiments, the stitch 18 has a tensile strength of at least 90,000 psi. In some embodiments, the stitch 18 has a tensile strength of at least 100,000 psi. In some embodiments, the stitch 18 has a tensile strength of 115,000 psi. In some embodiments, the stitch 18 may be treated or coated for enhanced corrosion resistance. For example, the stitch 18 may be plated with zinc in some embodiments.

The system 10 is usable in a method of repairing a crack in a concrete installation. Particularly, in some embodiments, a user first prepares a concrete installation to be repaired. Preparing the concrete installation includes drilling holes or recesses on opposite sides of a crack in a concrete installation. In some embodiments, each of the holes is spaced from the crack by a distance of at least about 6 inches. In some embodiments (e.g., when the concrete installation has a slab thickness of at least 5 inches), the holes are drilled to a depth of about 4 inches and have a diameter of about ⅝ inches. In other embodiments (e.g., when the concrete installation has a slab thickness less than 5 inches), the holes may be drilled to a shallower depth and a smaller diameter for use with smaller anchors 22.

Next, a recess or channel is cut into the concrete installation between the drilled holes (e.g., using a masonry saw, a chipping hammer, etc.). The channel may be cut to a depth of about 1½ inches along the entire length of the channel. Alternatively, if the slab thickness of the concrete installation is less than 5 inches, the channel may be cut to a shallower depth, such as about ½ of an inch. After forming the holes and the channel, in some embodiments, an epoxy, such as AE-2200-250 Anchoring Epoxy by AquaBond®, is applied into the holes and along the bottom of the channel.

After preparing the concrete installation, the user positions the system 10 on the concrete installation. In some embodiments, the stitch 18 is coupled to the anchor plates 14 (e.g., via one of the attachment features) so as to span between the anchor plates 14. The anchor plates 14 and the stitch 18 are positioned in the channel so as to be recessed below the outer surface of the concrete installation. In particular, the anchor plates 14 are positioned over the drilled holes, with the anchor bores 54 aligned with the holes. Then, an anchor 22 is inserted through the anchor bore 54 of each anchor plate 14 and secured into the hole (e.g., by tightening the anchor 22 to a specified torque). For example, in some embodiments, each anchor 22 is tightened to a torque of about 50 foot-pounds. The stitch 18 links the concrete on opposite sides of the crack to permit load transfer across the crack. In some embodiments described, the system 10 may optionally be configured to allow post-tensioning across the crack to further strengthen the repair. In other embodiments, post-tensioning may not be required.

The process can be repeated to install multiple stitches 18 along the length of the crack if necessary. In some embodiments, multiple stitches 18 may be positioned along the crack at a spacing between 8 inches and 12 inches between adjacent stitches 18.

In some embodiments, the stitches 18 may also be provided in various lengths to suit a particular concrete installation, and longer stitches 18 may be used (when space allows) to provide stronger repairs. For example, in some embodiments, a particular stitch 18 may have an overall length of about 6-inches, about 12-inches, about 18-inches, or about 24-inches. Other lengths may also be provided. In some embodiments, the system 10 may include a plurality of stitches 18 having a plurality of different overall lengths.

Figure 4:
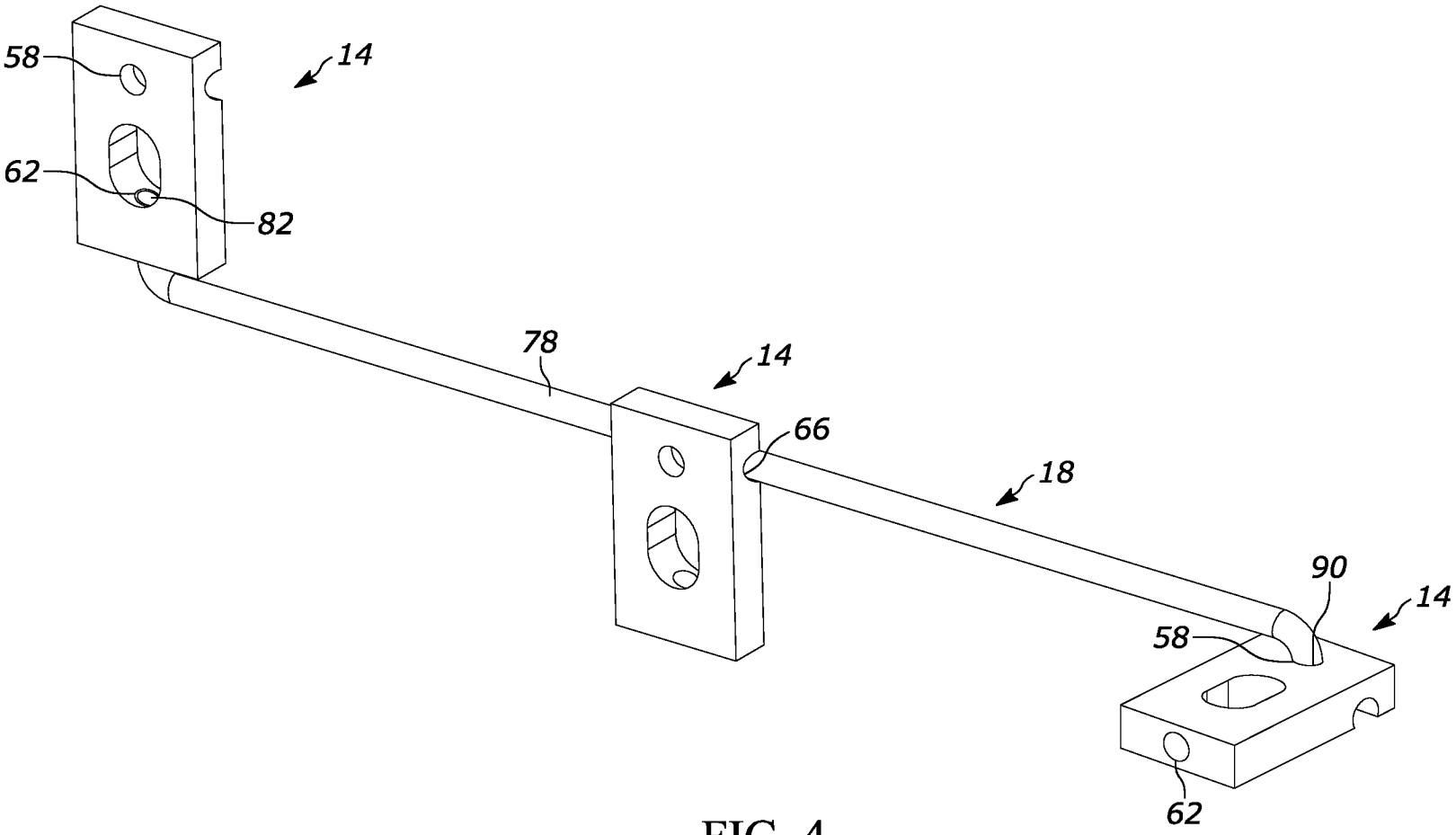
FIG. 4 is a perspective view illustrating the anchor plate of FIG. 2A coupled to the stitch of FIG. 3A in various ways.

The attachment features of the anchor plate 14, combined with the geometry of the stitch 18, advantageously permits the system 10 to be configured in a variety of different ways to facilitate use in a wide variety of concrete installations. For example, with reference to FIG. 4, the end segments 82, 90 of the stitch 18 are insertable into the first bore 58 or the second bore 62 of the anchor plate 14 to couple the stitch 18 to the anchor plate 14. The center portion 78 of the stitch 18 is insertable into the groove 66 to couple the stitch 18 to the anchor plate 14 at any position along the length of the center portion 78. Because the groove 66 has the same diameter as the bores 58, 62 in the illustrated embodiment, the end segments 82, 90 can alternatively be inserted into the groove 66 of an anchor plate 14 to couple the anchor plate 14 to the stitch.

Figure 11:
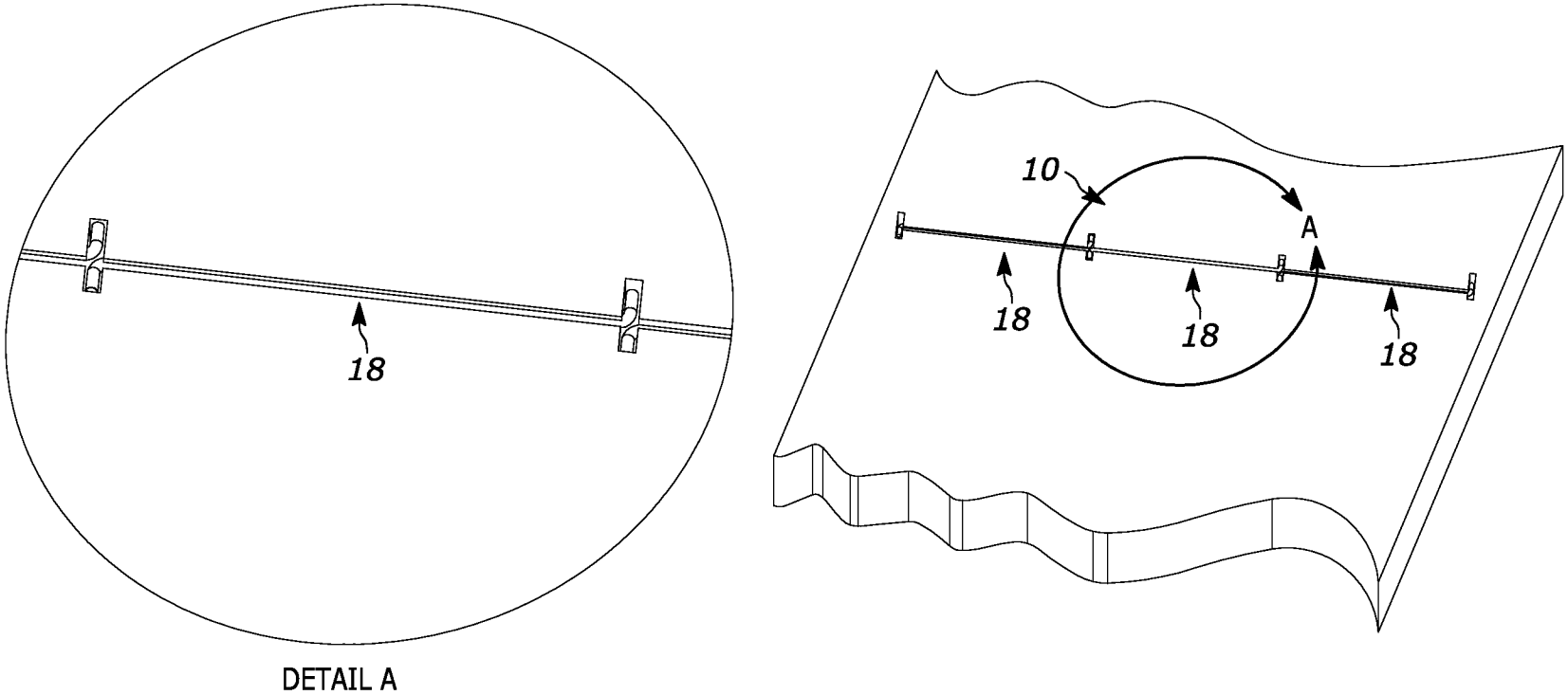
FIG. 11 illustrates the system of FIG. 1 in a seventh configuration.

In some embodiments, (e.g., when the slab thickness is less than 5 inches), the system 10 may be configured for use without the anchors 22 or anchor plates 14. For example, in one configuration illustrated in FIG. 11, multiple stitches 18 can be positioned end to end in a generally linear manner. In the illustrated embodiment, adjacent stitches 18 are positioned such that the end portions of adjacent stitches 18 overlap. The overlapping end segments of the stitches 18 may be oriented to extend in opposite directions, as illustrated in FIG. 11, to distribute stress on the concrete. In other embodiments, the end portions of adjacent stitches 18 may be hooked together using the bent geometry of the stitches 18.

Figure 12:
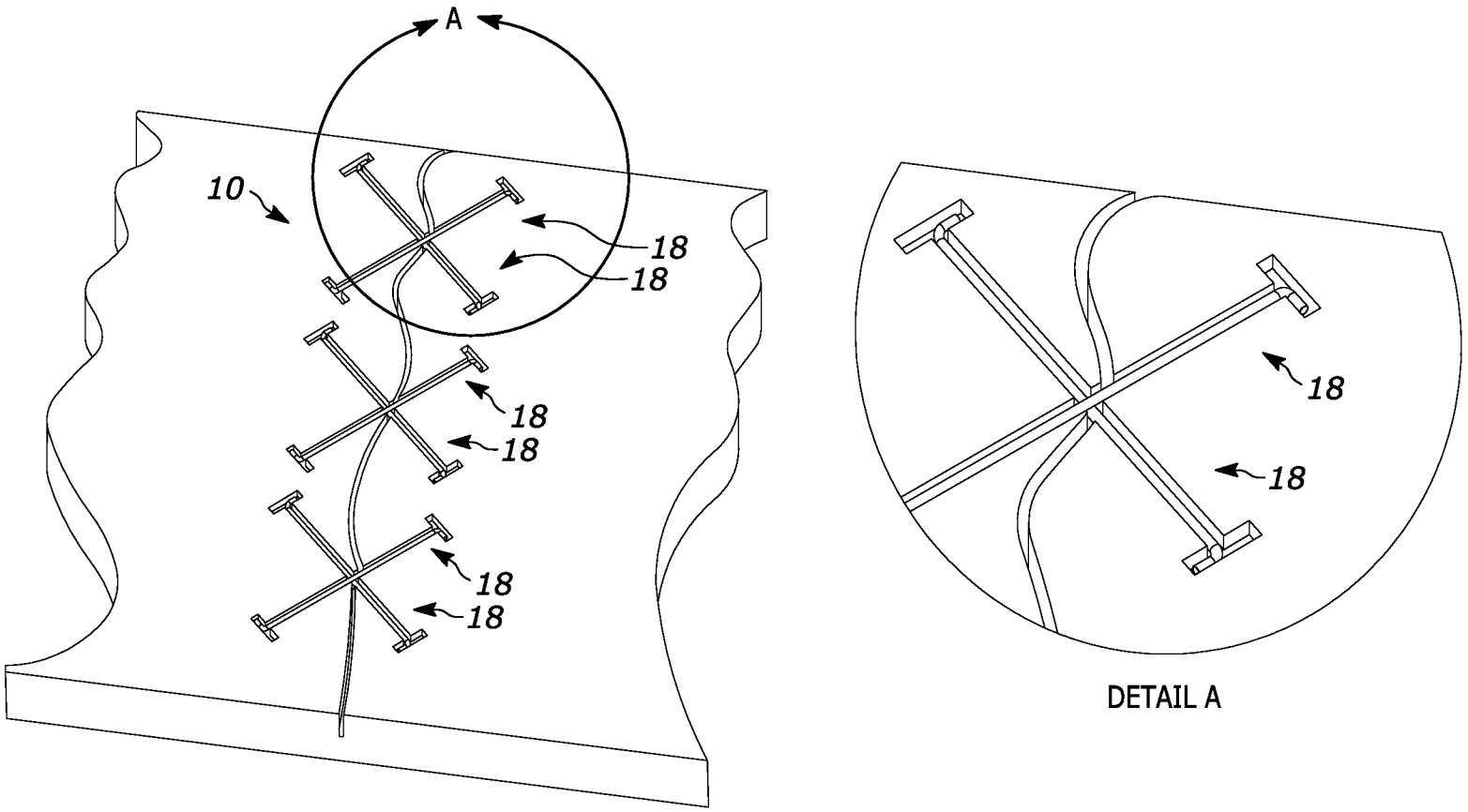
FIG. 12 illustrates the system of FIG. 1 in an eighth configuration.

In another configuration illustrated in FIG. 12, multiple stitches 18 may be arranged in a crossing or X-type pattern, which may provide additional strength. The intersection point of the crossed stitches 18 may be aligned with the crack to be repaired, or offset from the crack. In some embodiments, the stitches 18 may be arranged in an alternating straight and crossing pattern.

In some embodiments, such as those illustrated in FIGS. 11 and 12, the end portions of each stitch 18 may be positioned in the respective recesses or holes formed in the concrete installation on either side of the crack, and the center portion of each stitch 18 may be positioned in the channel that extends between the recesses.

Once each of the stitches 18 is positioned in its respective channel, the epoxy may be allowed to cure for a curing time period. In some embodiments, the curing time period is at least 24 hours. After the epoxy is cured, each channel is filled with concrete, non-shrinking hydraulic cement, foam (e.g., polyurethane foam), or any other suitable filling material, to encase all of the stitches 18, anchors 22, and anchor plates 14 of the system 10 and inhibit moisture and/or oxygen intrusion.

The material properties of the stitch 18, including its cold-rolled processing and high tensile strength, advantageously provides for stronger and longer lasting repairs while minimizing the diameter of the stitch 18. As such, the required size of the channel is minimized, which reduces disruption to the surface of the concrete installation. Finally, the inventors discovered that material properties of the stitch 18 may also advantageously provide longer-lasting repairs by minimizing creep. Creep is a deformation mechanism that is a function of a material's properties, temperature exposure, time, and applied structural load. Reinforcing metals in concrete installations are not typically subject to high temperatures where creep is commonly observed and accounted for. The inventors have found, however, that creep may also occur and contribute to failures within concrete installations, at least in part due to high structural loads that exist for an extended period of time. The cold-rolled processing and high tensile strength of the stitch 18 advantageously minimize the creep potential of the stitch 18.

The material properties of the stitch 18 and its geometry (including the angled end segments 82, 90 in some embodiments) may advantageously provide a strong modulus for locking and limiting future movement of a fractured wall or other concrete installation due to heaving or other environmental factors. In some embodiments, an even stronger modulus may be provided by layering stitches 18 on top of one another (either longitudinally or in a crossing pattern), and coupling the layered stitches 18 together with epoxy. Thus, concrete repairs made using the systems and methods described herein may be longer lasting and more resistant to heaving than typical concrete repairs.

Figure 3B:
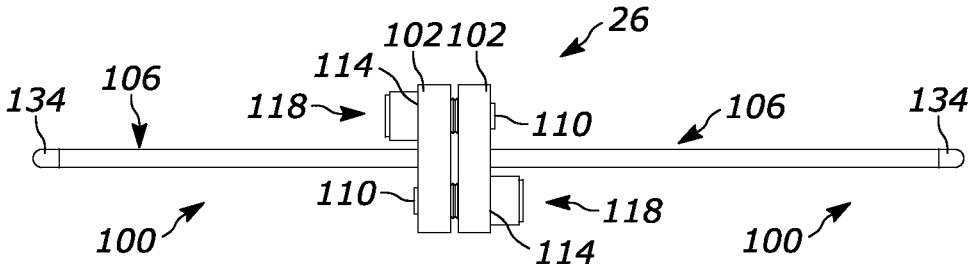
FIG. 3B is a plan view of a tensioning assembly of the system of FIG. 1.
Figure 3C:
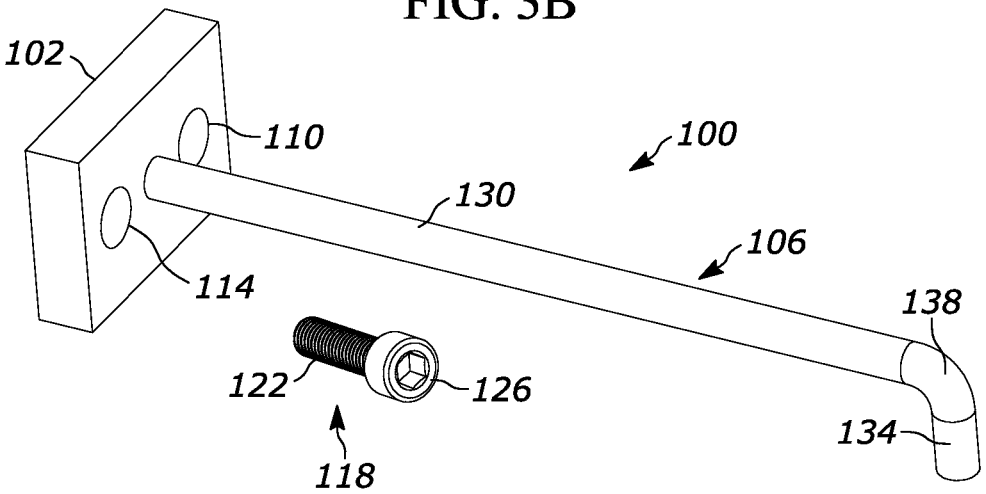
FIG. 3C is a perspective view of a portion of the tensioning assembly of FIG. 3B.

Referring to FIGS. 3B and 3C, in some embodiments, the system 10 may include one or more tensioning assemblies 26. The illustrated tensioning assembly 26 includes two sub-assemblies 100, each with a base plate 102 and a rod 106 extending from the base plate 102. The rod 106 comprises a cold-rolled material, including cold rolled alloys sometimes referred to by the trade name Stressproof®. The cold-rolled material can comprise a material conforming to AISI 1144. AISI 1144 steel is a carbon-manganese grade steel which is cold worked to produce high tensile properties. In some embodiments, the rod 106 has a tensile strength of at least 90,000 psi. In some embodiments, the rod 106 has a tensile strength of at least 100,000 psi. In some embodiments, the rod 106 has a tensile strength of 115,000 psi.

The base plate 102 includes a first bore 110 and a second bore 114, each configured to receive a threaded fastener 118 (FIG. 3C). The first bore 110 is threaded to match the threads of the fastener 118. The second bore 114 is unthreaded and sized such that a stem 122 of the fastener 118 can pass through the bore 114 without threadably engaging the bore 114, but an enlarged head 126 of the fastener 118 cannot pass through the bore 114.

With reference to FIG. 3C, the rod 106 includes a first portion 130 coupled to the base plate 102 and an end segment 134 extending perpendicular or transverse to the first portion 130. A curved transition 138 is defined between the first portion 130 and the end segment 134. The rod 106 has a diameter approximately equal to the diameter 98 of the stitch 18. As such, the first portion 130 and the end segment 134 of the tensioning assembly 26 can interface with the attachment features of the anchor plate 14 to couple the tensioning assembly 26 to the anchor plate 14 in various ways.

Illustrated in FIG. 3B, the two tensioning sub-assemblies 100 are coupled together with the base plates 102 in a facing relationship and the rods 106 extending in opposite directions. The two fasteners 118 extend in opposite directions, through the second bore 114 of each base plate 102 and into threaded engagement with the first bore 110 of each base plate 102. Thus, tightening the respective fasteners 118 will draw the base plates 102 closer together, thereby decreasing the distance between the end segments 134 of the respective rods 106. The rods 106 and the tensioning sub-assemblies 100 may collectively be referred to as a stitch.

Figure 3D:
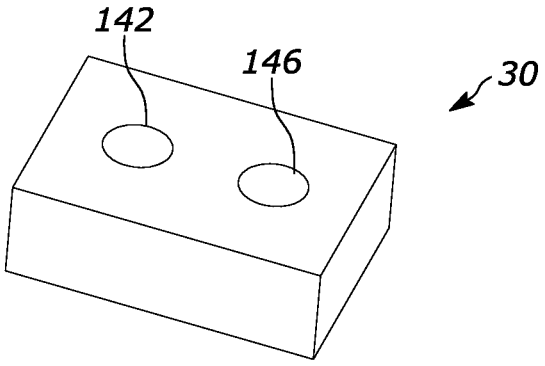
FIG. 3D is a perspective view of a bridge plate of the system of FIG. 1.

Referring to FIG. 3D, in some embodiments, the system 10 may include one or more bridge plates 30. The illustrated bridge plate 30 includes a first bore 142 and a second bore 146. The bores 142, 146 are sized to receive the end segments 82, 90 of the stitch 18 or the end segment 134 of the tensioning assembly 26. The end segments 82, 90, 134 may pivot within the bores 142, 146 in some embodiments. Thus, the bridge plate 30 may couple multiple stitches 18 and/or tensioning assemblies 26 together at a variety of different angular orientations.

The modular nature of the system 10 allows for multiple anchor plates 14 to be coupled to a single stitch 18 and positioned relative to the stitch 18 in various ways. In other embodiments, multiple stitches 18 may be coupled to a single anchor plate 14. In yet other embodiments, one or more tensioning assemblies 26 may be coupled to an anchor plate 14, with or without a stitch 18. In some embodiments, the bridge plate 30 may couple multiple stitches 18, anchor plates 14, and/or tensioning assemblies 26 together. Several exemplary configurations of the system 10 are described and illustrated herein. One of ordinary skill in the art would understand, however, that the system 10 may also be used in other configurations to suit the particular geometry and properties of a crack to be repaired.

Figure 5A:
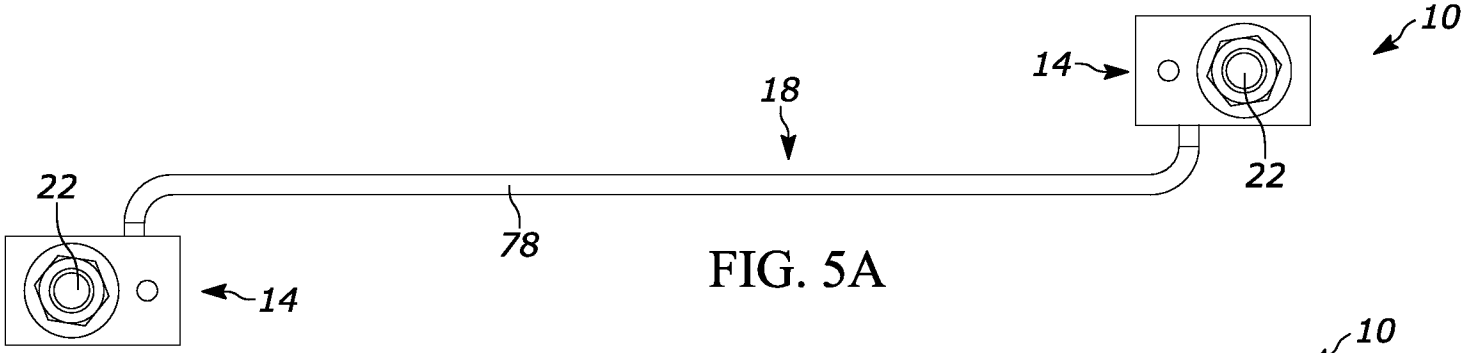
FIG. 5A illustrates the system of FIG. 1 in a first configuration.

For example, FIG. 5A illustrates the system 10 in a first configuration. In the first configuration, the system 10 includes two anchor plates 14, two anchors 22 (each associated with one of the respective anchor plates 14), and a single stitch 18. The end segments 82, 90 (FIG. 3A) of the stitch 18 are received within the grooves 66 (FIG. 2A) of each anchor plate 14 to couple the anchor plates 14 to the stitch 18. In the first configuration, the anchors 22 and anchor plates 14 are offset from one another, on opposite sides of the center portion 78 of the stitch 18.

Figure 5B:
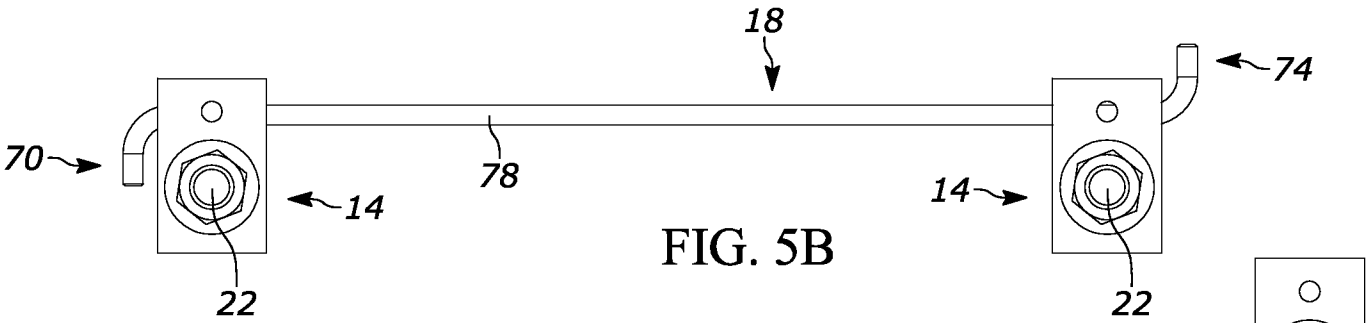
FIG. 5B illustrates the system of FIG. 1 in a second configuration.

FIG. 5B illustrates the system 10 in a second configuration. In the second configuration, the system 10 includes two anchor plates 14, two anchors 22 (each associated with one of the respective anchor plates 14), and a single stitch 18. The center portion 78 of the stitch 18 is received within the groove 66 of each anchor plate 14, and the anchor plates 14 are spaced apart so as to be positioned adjacent the end portions 70, 74. In the second configuration, the anchors 22 and anchor plates 14 are aligned on the same side of the center portion 78 of the stitch 18.

Figure 5C:
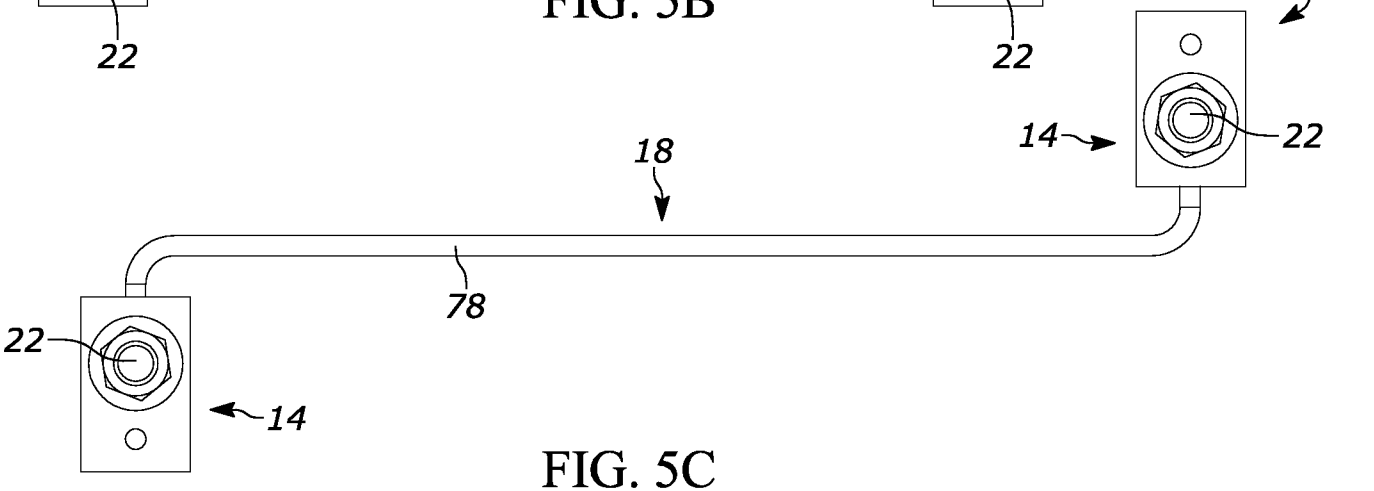
FIG. 5C illustrates the system of FIG. 1 in a third configuration.

FIG. 5C illustrates the system 10 in a third configuration. In the third configuration, the system 10 includes two anchor plates 14, two anchors 22 (each associated with one of the respective anchor plates 14), and a single stitch 18. The end segments 82, 90 (FIG. 3A) of the stitch 18 are received within the second bores 62 (FIG. 2A) of each anchor plate 14 to couple the anchor plates 14 to the stitch 18. In the third configuration, the anchors 22 and anchor plates 14 are offset from one another, on opposite sides of the center portion 78 of the stitch 18, like in the first configuration. The anchors 22, however, are closer together in the third configuration than in the first configuration.

Thus, it is evident from at least the configurations described and illustrated above with reference to FIGS. 5A-5C that the modular nature of the system 10 advantageously permits varied placement of the anchor plates 14 and anchors 22 along the stitch 18. In certain embodiments, the angle of the ends of the stitch can vary in a range from 0-180 degrees.

Figure 6A:
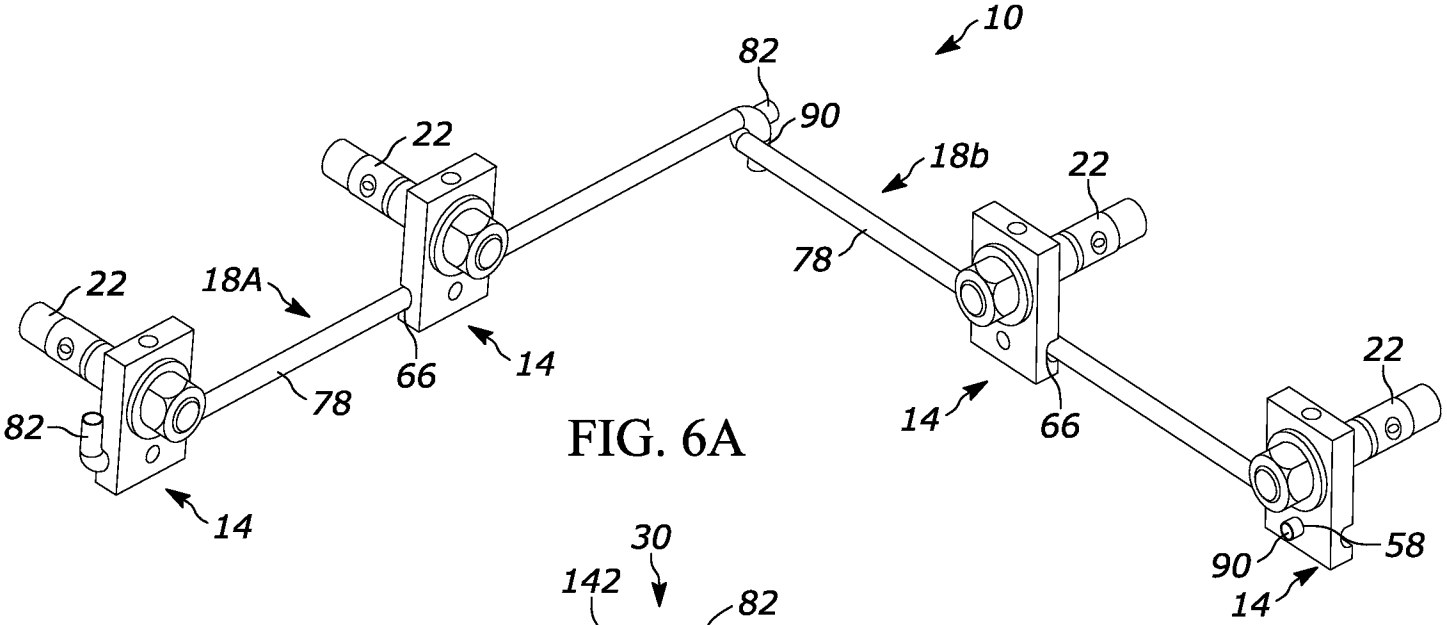
FIG. 6A illustrates the system of FIG. 1 in a fourth configuration.

FIG. 6A illustrates the system 10 in a fourth configuration. In the fourth configuration, the system 10 includes four anchor plates 14, four anchors 22, each associated with one of the respective plates 14, and two stitches 18*a*, 18*b*. The first end segment 82 of the stitch 18*a* is hooked with the second end segment 90 of the stitch 18*b*, generally forming a pivotal connection and permitting adjustment of the angle between the stitches 18*a*, 18*b*. The connection between the end segments 82, 90 advantageously allows for tensile load transfer between the stitches 18*a*, 18*b*, and facilitates the repair and strengthening of cracks in concrete installations across corners or bends.

Figure 6B:
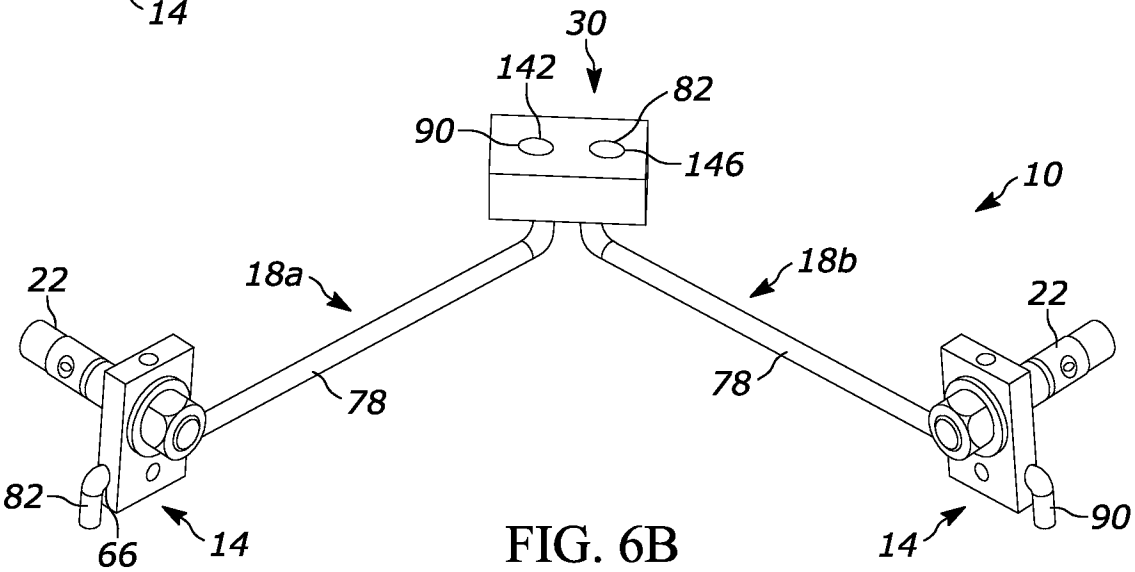
FIG. 6B illustrates the system of FIG. 1 in a fifth configuration.

FIG. 6B illustrates the system 10 in a fifth configuration. In the fifth configuration, the system 10 includes two anchor plates 14, two anchors 22 (each associated with one of the respective anchor plates 14), two stitches 18*a*, 18*b*, and a bridge plate 30. The second end segment 90 of the stitch 18*a* is received within the first bore 142 of the bridge plate 30, forming a pivotal connection. Likewise, the first end segment 82 of the stitch 18*b* is received within the second bore 146 of the bridge plate 30, forming a pivotal connection. The bridge plate 30 thus permits adjustment of the angle between the stitches 18*a*, 18*b*. The connection between the end segments 82, 90 and the bridge plate 30 also advantageously allows for tensile load transfer between the stitches 18*a*, 18*b*, and facilitates the repair and strengthening of cracks in concrete installations across corners or bends.

Figure 7A:
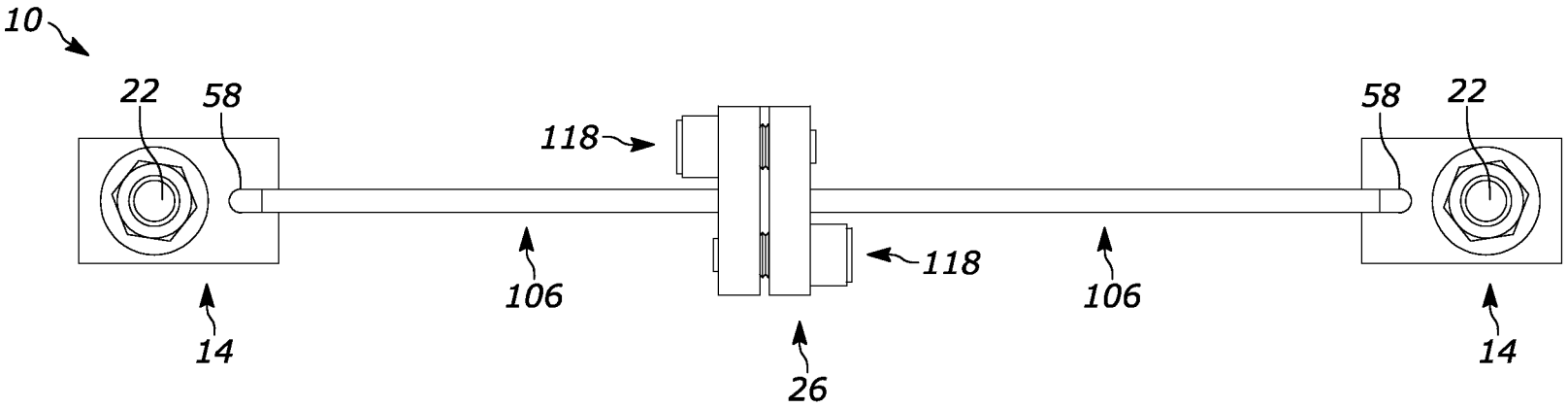
FIGS. 7A-B illustrate the system of FIG. 1 in a sixth configuration.
Figure 7B:
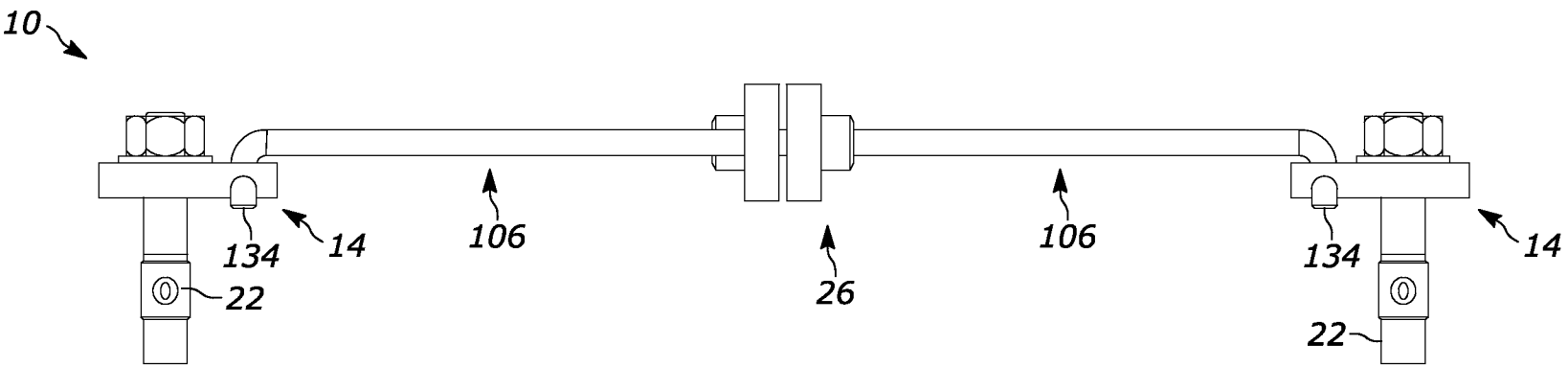

FIGS. 7A-B illustrate the system 10 in a sixth configuration. In the sixth configuration, the system 10 includes two anchor plates 14, two anchors 22 (each associated with one of the respective anchor plates 14), and a tensioning assembly 26 spanning between the two anchor plates 14. In particular, the end segments 134 of the tensioning assembly 26 extend through the first bore 58 of each anchor plate 14.

In use, the anchors 22 are secured into anchor holes drilled into a concrete installation to be repaired on opposite sides of a crack, generally in the same manner as in the method described above. The tensioning assembly 26 is positioned to extend between the anchor plates 14 and across the crack. As such, the tensioning assembly 26 defines a stitch that spans across the crack. An operator can then tighten the fasteners 118 on the tensioning assembly 26, which applies tension to the rods 106 and anchor plates 14, tending to draw the anchors 22 closer together and closing a gap between the base plates 102 of each sub-assembling 100. In some embodiments, the gap between the base plates 102 may be fully closed by rotating each of the fasteners 118 about 180 degrees. Closure of the gap between the base plates 102 may indicate to the user that proper post-tensioning has been performed. The system 10 including the tensioning assembly 26 can thus apply adjustable tension across a crack, strengthening the crack and allowing for load transfer across the crack.

Figure 8A:
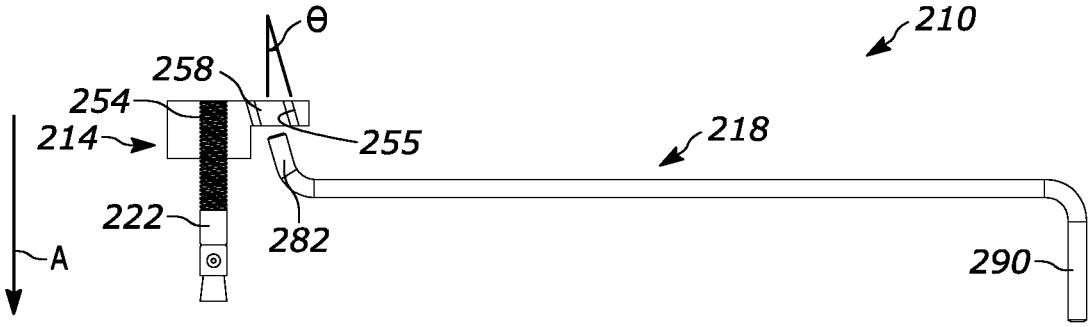
FIGS. 8A-C illustrate a post-tensioning operation of the system of FIG. 1 in a seventh configuration.
Figure 8B:
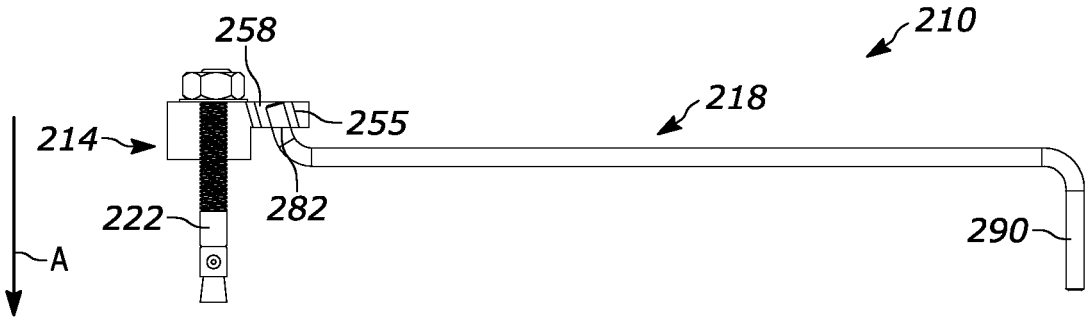
Figure 8C:
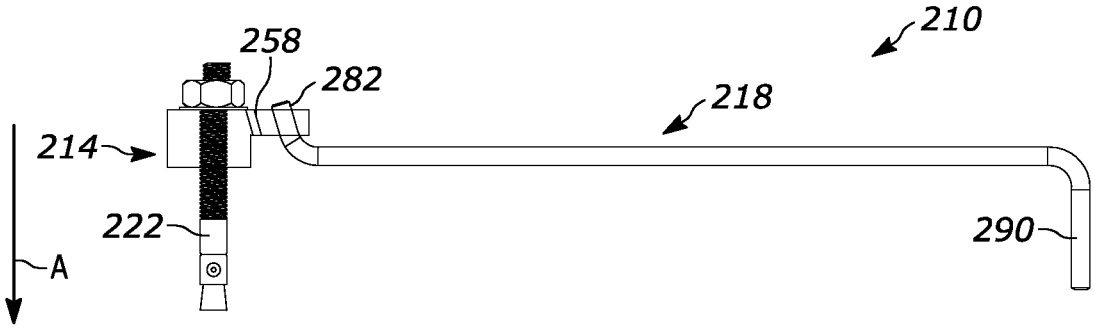

FIGS. 8A-C illustrate a system 210 according to another embodiment. The system 210 is similar to the system 10, and features and elements of the system 210 corresponding with features and elements of the system 10 described above with reference to FIGS. 1-7B are given like reference numbers plus '200.' In addition, the following description focuses primarily on differences between the system 210 and the system 10.

The system 210 integrates the function of the tensioning assembly 26 with the anchor plate 14. In particular, the system 210 includes an anchor plate 214 with a first bore 258 that is obliquely angled relative to the anchor bore 254 so as to define a cam surface 255. The stitch 218 of the system 210 includes one end segment 282 that is obliquely angled relative to the center portion 278. In the illustrated embodiment, the cam surface 255 extends at an angle θ of about 15 degrees relative to vertical, with reference to the orientation illustrated in FIG. 8A. In other embodiments, the angle θ is between 5 degrees and 45 degrees. In other embodiments, the angle θ is between 10 degrees and 30 degrees.

In use, when the anchor 222 is tightened, the anchor plate 214 is forced downward in the direction of arrow A. The cam surface 255 in the first bore 258 bears against the end segment 282 to draw the opposite end segment 290 of the stitch 218 toward the anchor 222. This allows for tension to be applied across the crack.

FIGS. 9A-10B illustrate a system 410 according to another embodiment. The system 410 is similar to the system 10, and features and elements of the system 410 corresponding with features and elements of the system 10 described above with reference to FIGS. 1-7B are given like reference numbers plus '400.' In addition, the following description focuses primarily on differences between the system 410 and the system 10.

Figure 9A:
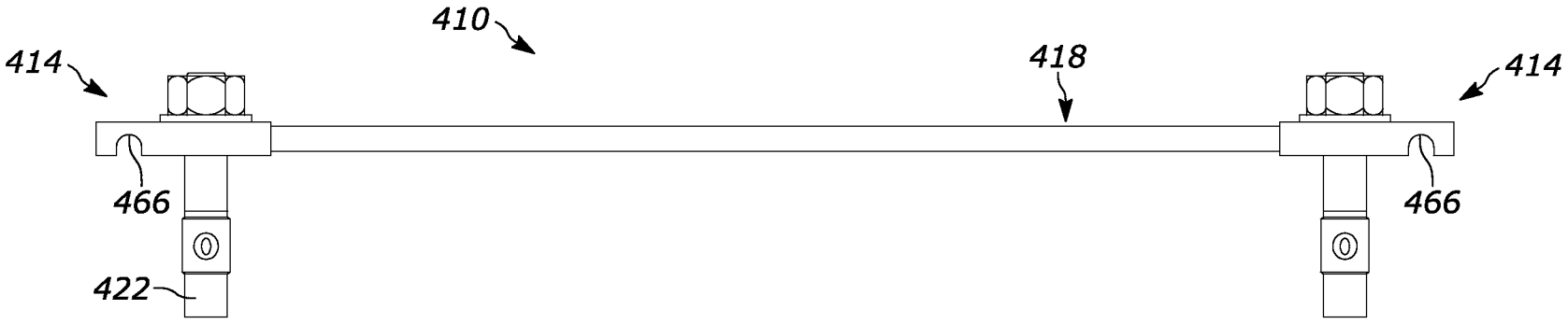
FIGS. 9A-B illustrate a modular concrete crack repair system according to another embodiment of the present invention, in a first configuration.
Figure 9B:
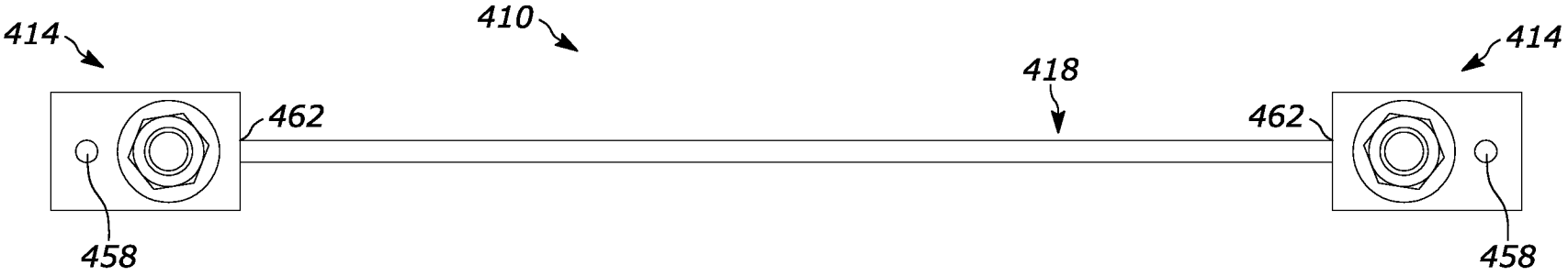

With reference to FIGS. 9A-B, in a first configuration of the system 410, the stitch 418 is configured as a straight rod. The stitch 418 extends between two anchor plates 414 and is welded to the respective anchor plates 414. In some embodiments, the ends of the stitch 418 are inserted into the second bores 462 prior to welding, which guides and aligns the stitch 418 with respect to the anchor plates 414. In other embodiments, the ends of the stitch 418 may be fixed to the anchor plates 414 in other ways, such as by epoxy, brazing, one or more mechanical fasteners (e.g., set screws), or the like.

Figure 10A:
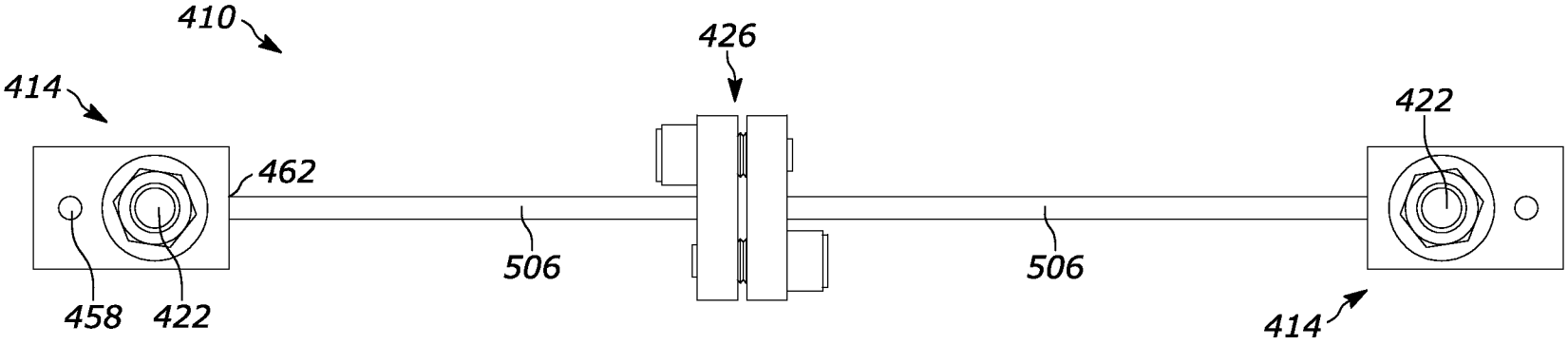
FIGS. 10A-B illustrate the system of FIGS. 9A-B in a second configuration.
Figure 10B:
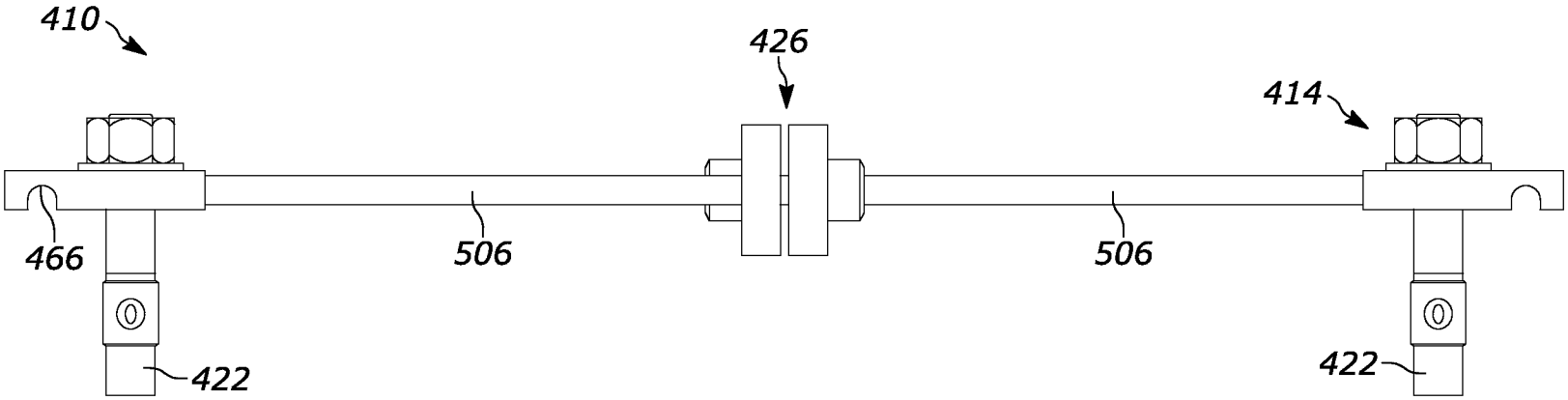

With reference to FIGS. 10A-B, in a second configuration of the system 410, the rods 506 of the tensioning assembly 426 are configured as straight rods. Like the stitch 418, the tensioning assembly 426 extends between the two anchor plates 414 and the rods 506 are welded to the respective anchor plates 414. In some embodiments, the ends of the rods 506 are inserted into the second bores 462 prior to welding, which guides and aligns the rods 506 with respect to the anchor plates 414. In other embodiments, the ends of the rods 506 may be fixed to the anchor plates 414 in other ways, such as by epoxy, brazing, one or more mechanical fasteners (e.g., set screws), or the like.

In alternate embodiments (not shown), the stitch 418 or one of the rods 506 may be generally L-shaped, including an end segment that extends at an angle relative to the remainder of the stitch 418 or rod 506. In such embodiments, the stitch 418 or the rod 506 may be fixed to one of the anchor plates 414 and coupled to the other anchor plate 414 via one of the attachment features (458, 462, 466) of the anchor plate 414. Alternatively, the second anchor plate 414 may be omitted and the end segment configured to interface directly with the concrete installation to be repaired.

As evidenced by the various exemplary embodiments and configurations described herein, the present disclosure provides a modular system and method for concrete crack repair that may advantageously be used on concrete installations of various sizes, thicknesses, and shapes (e.g., corners, curves, and straight surfaces) to durably repair cracks of various types and severities.

Although the invention has been described in detail with reference to certain preferred embodiments, variations and modifications exist within the scope and spirit of one or more independent aspects of the invention as described.

Various features of the invention are set forth in the following claims.

What is claimed is:

1. A system for repairing a crack in a concrete installation, the system comprising:

a stitch including a first end segment, a center portion configured to span across the crack, a second end segment, and a tensioning assembly configured to vary a distance between the first end segment and the second end segment; and an anchor plate coupled to the stitch, the anchor plate including an anchor bore configured to receive a concrete anchor, a first bore extending parallel to the anchor bore, a second bore extending transverse to the anchor bore, and a groove extending transverse to the first bore and the second bore, wherein the first bore intersects the groove, and wherein the second bore intersects the anchor bore.

2. A system for repairing a crack in a concrete installation, the system comprising:

a stitch including a first end segment, a center portion configured to span across the crack, and a second end segment; and an anchor plate coupled to the stitch, the anchor plate including an anchor bore configured to receive a concrete anchor, a first bore extending parallel to the anchor bore, a second bore extending transverse to the anchor bore, and a groove located in a bottom side of the anchor plate and extending transverse to the first bore and the second bore, wherein the first bore intersects the groove, and wherein the second bore intersects the anchor bore.

3. The system of claim 2, wherein the anchor plate is one of a plurality of anchor plates coupled to the stitch, and wherein each of the plurality of anchor plates is identical.

4. The system of claim 2, wherein the stitch includes a tensioning assembly operable to vary a distance between the first end segment and the second end segment while the stitch is coupled to the anchor plate.

5. The system of claim 2, wherein the first bore, the second bore, and the groove have substantially equal diameters.

6. The system of claim 2, wherein the first bore, the second bore, and the groove are each sized to receive at least a portion of the stitch.

7. The system of claim 2, wherein the stitch is made of cold-rolled steel having a tensile strength of about 90,000 psi to about 115,000 psi.

8. The system of claim 2, wherein the first end segment and the second end segment are angled relative to the center portion.

9. The system of claim 8, wherein the first end segment and the second end segment extend in opposite directions from the center portion.

10. The system of claim 2, wherein the anchor plate includes:

a top side, the bottom side opposite the top side, a first lateral side extending between the top side and the bottom side, a second lateral side extending between the top side and the bottom side, a third lateral side extending between the top side and the bottom side opposite the first lateral side, and a fourth lateral side extending between the top side and the bottom side opposite the second lateral side.

11. The system of claim 10, wherein the first bore and the anchor bore extend through the top side and the bottom side.

12. The system of claim 11, wherein the second bore extends through the second lateral side.

13. The system of claim 11, wherein the groove extends through the first lateral side and the third lateral side.

14. A method of repairing a crack in a concrete installation, the method comprising:

providing the system of claim 2;

forming a first recess in the concrete installation on a first side of the crack;

forming a second recess in the concrete installation on a second side of the crack opposite the first side;

forming a channel in the concrete installation between the first and second recesses;

applying an epoxy into the first recess, the second recess, and the channel; and positioning the stitch in the channel such that the center portion of the stitch spans across the crack from the first side to the second side;

coupling the stitch to the anchor plate;

inserting the anchor into the concrete installation through the anchor bore in the anchor plate; and tightening the anchor into the concrete installation.

15. The method of claim 14, wherein the stitch is made of cold-rolled steel having a tensile strength of about 90,000 psi to about 115,000 psi.

16. The method of claim 14, wherein positioning the stitch in the channel includes positioning the first end segment of the stitch in the first recess and positioning the second end segment of the stitch in the second recess, and wherein the first end segment and the second end segment are angled relative to the center portion.

17. The method of claim 16, wherein coupling the stitch to the anchor plate includes inserting one of the first end segment or the second end segment of the stitch through one of the first bore or the second bore in the anchor plate.

* * * * *